United States Patent [19]

Fleming, III

[11] Patent Number: 4,608,037

[45] Date of Patent: Aug. 26, 1986

[54] METHOD OF AND APPARATUS FOR ABRADING MECHANICALLY PERFORATED CIGARETTE FILTER TIPPING PAPER

[75] Inventor: William F. Fleming, III, Winston-Salem, N.C.

[73] Assignee: RJR Archer, Inc., Winston-Salem, N.C.

[21] Appl. No.: 603,262

[22] Filed: Apr. 23, 1984

[51] Int. Cl.[4] ..... B31F 7/00; B24B 5/38; B24B 9/02

[52] U.S. Cl. ..... 493/22; 493/342; 493/362; 493/363; 493/369; 493/370; 493/467; 51/74 R; 226/171

[58] Field of Search ..... 493/342, 362, 363, 369, 493/370, 373, 467, 22, 24, 372; 51/74; 226/171

[56] References Cited

U.S. PATENT DOCUMENTS

| | | | |
|---|---|---|---|
| 1,260,694 | 3/1918 | Marresford | 493/363 |
| 1,955,813 | 4/1934 | Klappenecker | 226/171 |
| 2,114,517 | 4/1938 | Apel et al. | 226/171 |
| 2,220,627 | 11/1940 | Sperry | 51/74 R |
| 2,699,208 | 1/1955 | Schur | 493/363 |
| 2,801,501 | 8/1957 | Marogg | 493/363 |
| 2,982,186 | 5/1961 | McKeen | 493/372 |
| 3,074,303 | 1/1963 | Waters | 493/369 |
| 3,179,025 | 4/1965 | Schur | 493/342 |
| 3,408,776 | 11/1968 | Kalwaites | 51/324 |
| 3,435,566 | 4/1969 | Enserink | 51/328 |
| 3,683,559 | 8/1972 | Kalwaites | 51/74 R |
| 3,780,626 | 12/1973 | Hollier, Jr. | 51/74 R |

*Primary Examiner*—Francis S. Husar
*Assistant Examiner*—William E. Terrell
*Attorney, Agent, or Firm*—Grover M. Myers

[57] ABSTRACT

The invention relates to method and apparatus for removing the flaps from a perforated web of paper by drawing the perforated web over an abrasively surfaced drum rotating in the same direction as the paper is traveling and at a peripheral speed about seven times greater than the speed of the web. The web is passed over the drum such that the flaps are at the leading or downstream edges of the perforations and lie between the paper and the drum. A spring-biased pressure yoke holds the perforated web against the drum surface with a predetermined amount of pressure to facilitate abrading the flaps from the web.

10 Claims, 5 Drawing Figures

METHOD OF AND APPARATUS FOR ABRADING MECHANICALLY PERFORATED CIGARETTE FILTER TIPPING PAPER

BACKGROUND OF THE INVENTION

The present invention relates to a method of and an apparatus for finishing the perforated holes in cigarette filter tipping paper, and more particularly to a method of and apparatus for abrasively removing the flaps formed adjacent the perforated holes during a mechanical perforation process.

One method of reducing the "tar" and nicotine delivery of a cigarette is through the use of air dilution. In order to produce air dilution, minute holes or perforations are formed in the cigarette filter tipping paper which allow air to be drawn laterally into the cigarette filter and combined with the tobacco smoke. One conventional method of forming the perforations is to mechanically perforate the filter tipping paper prior to forming the cigarette filter. Typically, the perforations are not punched completely clean, but rather small flaps of paper or paper fibers from the perforations remain affixed to the tipping paper adjacent each such perforation.

Throughout the specification and claims herein, the term "flap" is generally intended to describe those remnants of paper or paper fibers which remain adhered to the periphery of a mechanically perforated hole in a paper web as a result of a mechanical perforation process. In such a mechanical perforation operation for perforating a web of cigarette filter tipping paper, the perforations are typically formed in the web in a pair of spaced, longitudinally extending series of holes disposed closely adjacent to one another. Normally, a flap remains connected to the periphery of a perforation at the leading edge thereof.

During manufacture of the cigarette filter, some of the flaps are inadvertently "raked" back by the processing machinery, thus blocking the perforations associated with the flaps. The number of flaps raked back over the perforations varies widely, resulting in variations of air dilution and unpredictable "tar" and nicotine levels. Thus, there has been a need in the art for a simple and dependable method of and apparatus for removing the flaps from the tipping paper after holes have been mechanically perforated therein.

A search of the prior art failed to uncover any prior art references which disclose apparatus that would be suitable for accomplishing the required flap removal operation. One prior art reference, U.S. Pat. No. 2,801,501, discloses an apparatus for perforating tea bag paper wherein the paper is interposed between an embossing drum and two sanding belts which pass in opposite directions over diametrically opposed portions of the drum. One sanding belt is passed over the paper and drum in a direction opposite paper and drum rotation to abrade and perforate the paper against the embossments on the drum and the second belt travels in the same direction as the paper and drum rotation to buff off burrs on the paper web. One drawback of the prior art apparatus is that perforation and burr removal are performed on the same drum so that the projections on the embossing drum are abraded as well as the paper burrs, resulting in excessive wear of the drum. In addition, removal of the burrs is rendered more difficult and inefficient because the paper is not compressed between contiguous surfaces with a uniform pressure.

U.S. Pat. No. 3,435,566 discloses a method of deburring holes in a flat metal workpiece comprising conveying individual workpieces against a grinding wheel rotating at high speed relative to the speed of the workpiece and in the same direction in which the workpiece is conveyed. The method disclosed in that patent is not suitable for use on a continuous web of thin, flexible paper because the method relies on only a line contact between the workpiece and grinding wheel and there is no satisfactory means for controlling the pressure on a flexible paper workpiece. In addition, the very high relative speed between the grinding wheel and the workpiece would tend to destroy or damage a thin filter paper web.

SUMMARY AND OBJECTS OF THE INVENTION

In view of the foregoing limitations and shortcomings of the prior art methods and apparatus, as well as other disadvantages not specifically mentioned above, it should be apparent that there still exists a need in the art for an effective method and apparatus for removing flaps from mechanically perforated cigarette filter tipping paper. It is, therefore, a primary objective of this invention to fulfill that need by providing a simple and dependable method of and apparatus for abrading the flaps from the perforations in cigarette filter tipping paper.

More particularly, it is an important object of this invention to provide a method and apparatus that can be utilized to accurately and consistently remove flaps from perforated filter tipping paper after the paper has passed from a mechanical perforating station.

Another object of the invention is to provide a method of and apparatus for improving the uniformity of the size of the perforations in filter tipping paper to thereby achieve greater control of tar and nicotine levels and minimize the variability of such levels in low-tar cigarettes.

It is another object of the present invention to provide a method of and apparatus for continuously abrading the flaps from a perforated web of thin paper of indeterminate length without damaging the paper web or the perforations therein.

Yet another object of the present invention is to provide a method of and apparatus for applying a controlled abrading pressure to a rapidly advancing web of paper.

Briefly described, the aforementioned objects are accomplished according to the method aspects of the invention by passing a web of perforated paper over an abrasive drum rotating in the same direction as the paper web is traveling. As a result of the mechanical perforation operation upstream of the abrasive drum, flaps or fibrous debris are formed on one side of the paper adjacent the periphery of each perforation. The web is arranged such that, as it passes over the abrasive drum, the flaps are interposed between the paper web and the drum. The abrasive drum is rotated at a peripheral speed greater than the speed at which the paper web is advanced over the drum and in the same direction of travel as the web. Drum to paper speed ratio may be in the range of 5:1 up to 10:1, however, the preferred ratio is about 7:1.

As the perforated paper is advanced over the drum, it is pressed against the abrasive surface of the drum with an adjustable pressure to facilitate optimum abrading of the flaps from the paper web. To reduce wear of the abrasive surface, the drum is laterally reciprocated along its longitudinal axis at a relatively low frequency, i.e., about 0.5 to 1.0 cycles per minute, and at an amplitude of about ¼ to ½ inch.

According to the apparatus aspects of the invention, the apparatus for performing the above method comprises a rotatable drum surfaced with an abrasive material, such as sandpaper strips. Rollers are mounted upstream and downstream of the drum and parallel to the drum rotational axis for guiding a web of perforated paper over a predetermined arcuate portion of the drum periphery. The drum is rotated in the direction of travel of the paper web by a drive motor which is electrically slaved to the drive means for the mechanical perforating device located upstream of the drum. Paper speed is determined by the drive speed of the perforating device. Control means are provided in the electrical circuit for the drive motors for adjusting the relative speed between the drum and the paper web to the optimum drum to paper speed ratio of about 7:1.

A plurality of pressure yokes, each aligned with a respective series of perforations, is mounted over the drum on a vertically movable support. Three idler pulleys are mounted to each yoke in a triangular array and an endless steel band passes over each set of pulleys. The uppermost pulley at the apex of the triangular array is resiliently biased to apply tension to the steel band. When the yokes are lowered toward the drum, the lowermost reach of each endless band contacts the perforated portions of the paper web associated therewith over an arcuate portion of the drum so as to apply a predetermined pressure to the web. The yoke support is vertically movable so as to vary the pressure applied to the web by the bands and the arcuate extent over which pressure is applied to the bands.

The drum is mounted on a laterally reciprocable slide which is reciprocated back-and-forth by a stepping motor at a relatively slow rate to promote uniform abrasion of the perforations and to reduce wear of the abrasive material on the drum.

A plurality of suction shoes are arranged adjacent the drum and web surfaces upstream and downstream of the drum for drawing off debris from the abrading process. A roller brush is arranged transversely in the suction opening of each suction shoe for scouring flap debris from the abrasive drum and from the upper and lower surfaces of the web downstream of the drum.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF A PREFERRED EMBODIMENT

Figure 1:
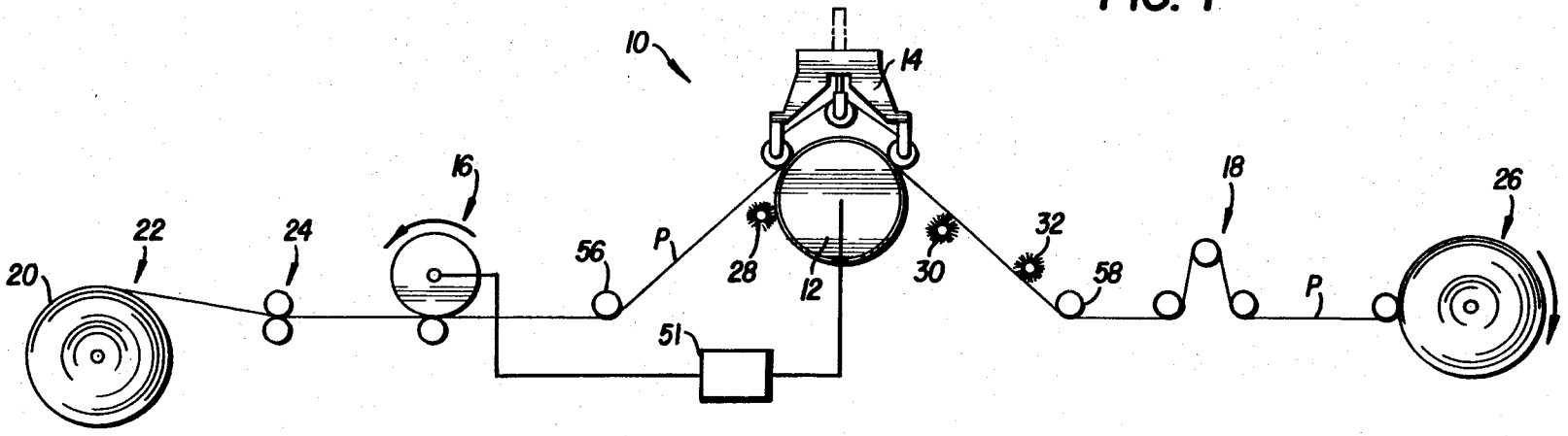
FIG. 1 is a schematic illustration of the apparatus of the present invention showing the abrasive treating apparatus integrated with a mechanical perforating system.

Referring now in detail to the drawings wherein like parts are designated by like reference numerals throughout, there is illustrated in FIG. 1 a schematic view of a system incorporating the abrading apparatus of the present invention which is designated generally by reference numeral 10. The apparatus 10 includes an abrading drum 12 and a plurality of pressure yokes 14 and is shown in position between a conventional mechanical perforator station 16 and a conventional porosity monitoring station 18. The abrading apparatus 10 is designed to abrade the flaps from a perforated paper web P that is drawn between the drum 12 and the yokes 14.

The paper web P is supplied from a roll 20 at unwind station 22 and passes through an infeed metering station 24 to the perforator station 16, thence to the abrading apparatus 10 and porosity monitoring station 18 and finally to rewind station 26. A drum cleaning brush 28 is arranged beneath the web P on the upstream side of the drum 12 for scouring debris from the drum. Web cleaning brushes 30, 32 are arranged downstream of the drum 12 for cleaning debris from the upper and lower surfaces of the web P.

Figure 2:
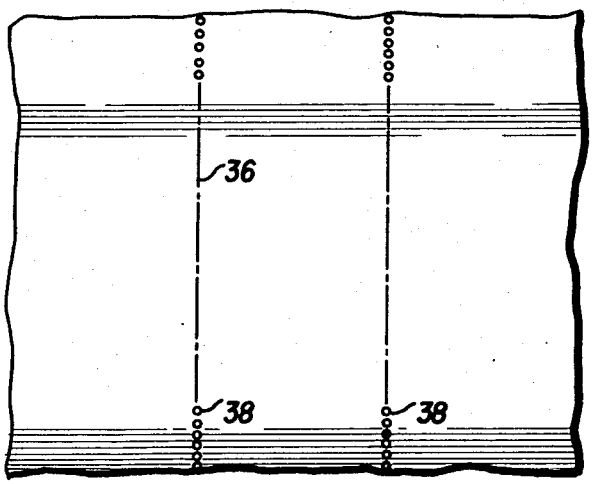
FIG. 2 is a plan view illustrating a portion of filter tipping paper web that is treated by the apparatus of the present invention.

A web of cigarette filter tipping paper, a portion 34 of which is shown in FIG. 2, is processed through the perforating station 16, where a plurality of longitudinal, parallel rows 36 of perforations are formed in the web. The paper web is preferably processed in multiple widths, that is in a width sufficient to form multiple cigarette filter tipping bands. The web is slit into appropriate widths for use on cigarette making machinery. The holes 39 are intended to enable dilutive air to be drawn laterally into the cigarette filter and combined with the tobacco smoke.

Figure 3:
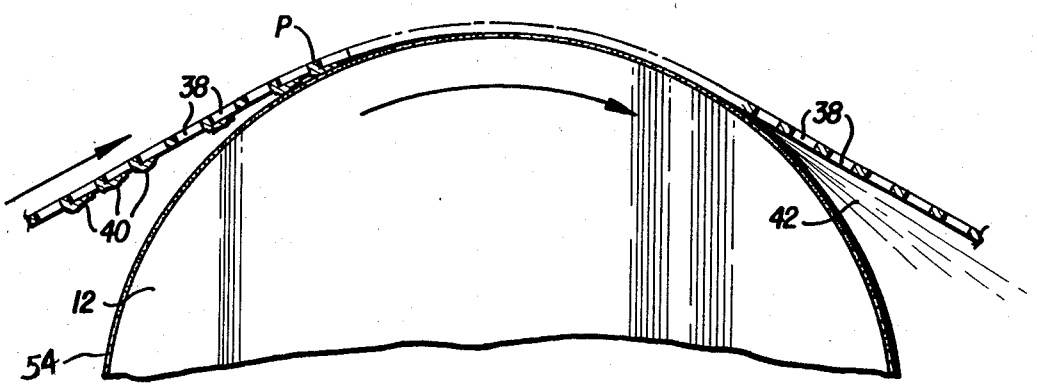
FIG. 3 is a schematic end view of the abrading drum of the present invention with the tipping paper web greatly magnified to illustrate the manner in which the flaps in the tipping paper pass over the drum.

As seen in FIG. 3 on the left-hand or upstream side of the drum 12, small flaps 40 are formed adjacent the leading or downstream edge of most of the holes 38 as a result of the mechanical perforation process at perforating station 16. If not removed, the flaps 40 would have a tendency to be folded or "raked" back into their respective holes 38, thus reducing the effectiveness of the holes and the porosity of the filter paper. To remove the flaps 40, the paper web P is drawn over the abrading drum 12, with the flaps 40 interposed between the outer, abrasive surface of the drum and the paper web P, as best seen in FIG. 3. The drum 12 is rotated in the same direction as the paper web is traveling, i.e., clockwise and to the right, respectively, as shown by the arrows in FIG. 3. Preferably, the peripheral speed of the drum is about seven times the speed of the paper web. As the paper web P passes over the drum 12, the flaps 40 are abraded into fine paper debris or dust 42 thereby leaving the holes 38 free of flaps and of a substantially uniform size as shown on the right-hand or downstream side of the drum in FIG. 3.

It will be appreciated that because of the greater speed of the drum relative to the web, the abrasive material will tend to draw the flaps in the direction of web travel and thus prevent the flaps from being "raked" back into the perforations. As the web P continues to pass over the drum periphery, the abrasive material eventually abrades away the flaps and/or severs the flaps from the web at the leading or downstream edges of the perforations.

Figure 4:
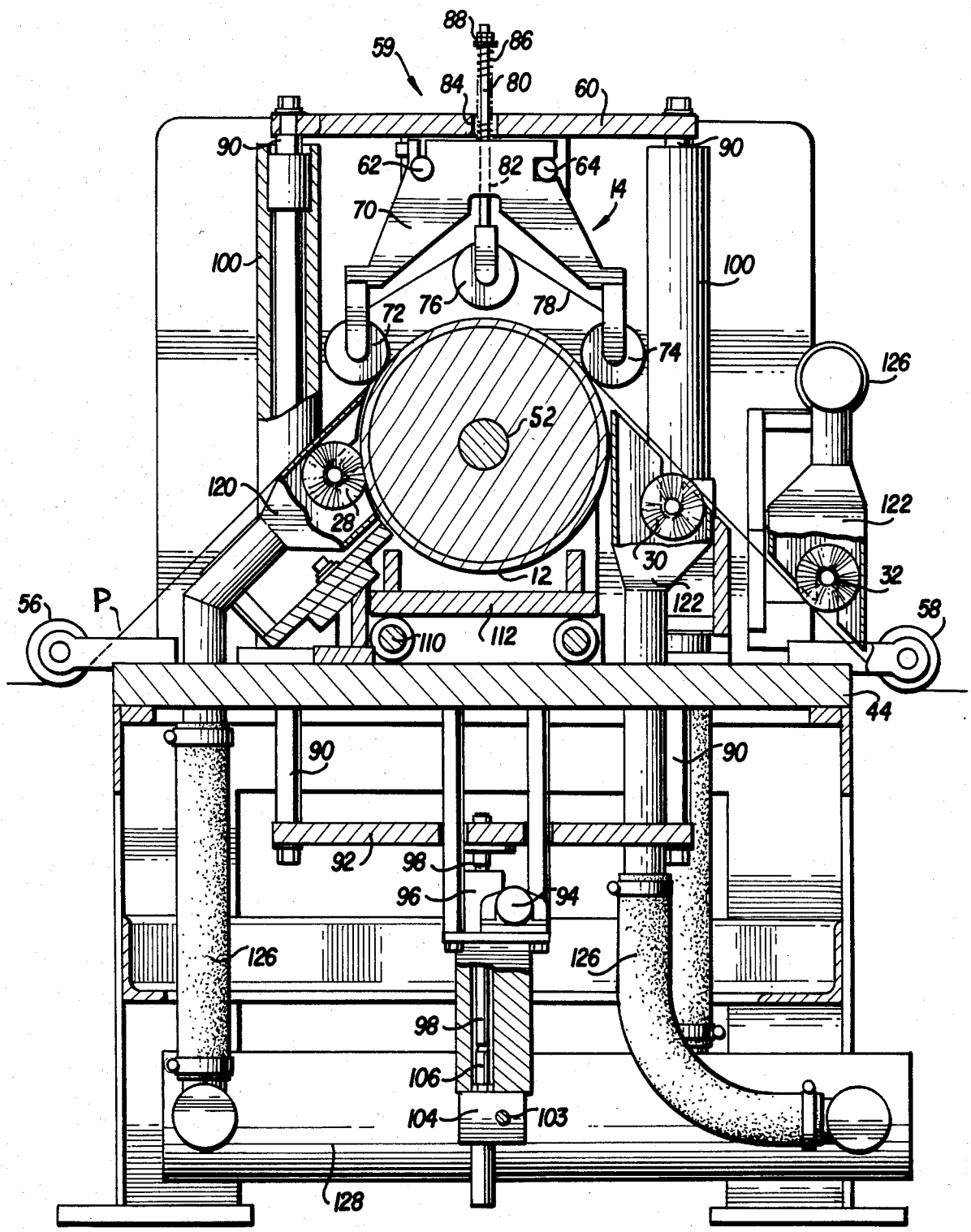
FIG. 4 is a side elevation view, partly broken and partly in section, of the abrading apparatus of the present invention with the paper web passing therethrough and with the pressure yoke assembly in its lowered, operative position.
Figure 5:
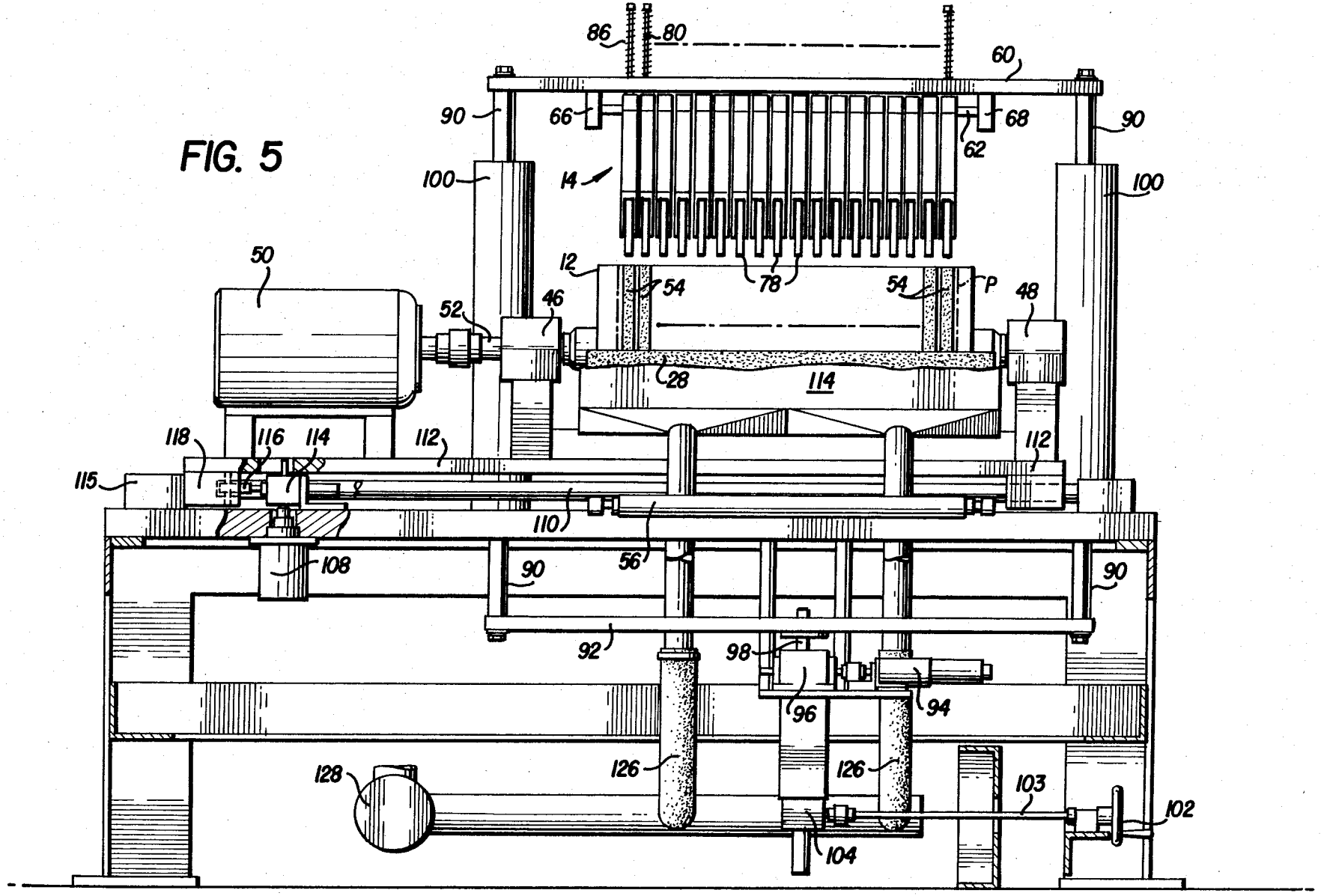
FIG. 5 is a front elevation view, shown partly broken, of the abrading apparatus of the present invention with the pressure yoke assembly in its raised position.

Referring now to FIGS. 4 and 5 of the drawings which illustrate a preferred embodiment of the invention, the abrading apparatus 10 comprises a base 44 upon which abrasive drum 12 is journalled in bearings (not shown) mounted in bearing blocks 46, 48 supported on the base as described in further detail hereinafter. The drum 12 is rotatably driven by a drive motor 50 connected to the drum shaft 52.

In a preferred configuration, the drum 12 is provided with eighteen (18) circumferential strips 54 of sandpaper or other suitable abrasive material. The strips are mounted in side-by-side relation as best seen in FIG. 5 and are preferably 400 grit paper, however, other grit sizes may be used. Alternatively, the entire drum surface could be covered with a single sheet of sandpaper.

In the preferred embodiment of the invention, a web P of multiple width filter tipping paper is supplied to the drum 12 from the roll 20. As previously described, in the perforator station 16, the web P is provided with a plurality of spaced longitudinal rows of perforations. Accordingly, the perforations of web P pass over the strips 54 of sandpaper such that each row of perforations in the web is aligned with a respective sandpaper strip.

After exiting the perforator station 16 (FIG. 1), the paper web P passes beneath a roller 56, over the drum 12 and beneath roller 58. The rollers 56, 58 are positioned relative to the drum 12 such that the web P contacts the periphery of the drum over an arcuate portion thereof of from about 60° to about 120° and preferably between about 80°–90°.

A pressure yoke assembly 59 is mounted above the drum 12 and comprises a yoke support plate 60 from which are suspended eighteen individual pressure yokes 14, each aligned with a respective strip of sandpaper on the drum. The yokes 14 are suspended beneath the yoke support plate 60 by means of a pair of parallel rods 62, 64 which are fixed at their ends to a pair of plates 66, 68 depending from plate 60. In FIG. 4 the yokes 14 are shown in their lowered, operative position engaging the drum 12 and in FIG. 5 the yokes are shown in their raised, inoperative position.

Each pressure yoke 14 comprises an inverted, generally U-shaped yoke member 70 to which are mounted, in a triangular array, three idler pulleys 72, 74, 76 over which an endless steel band 78 passes. The pulleys are journalled in anti-friction bearings (not shown) so that the endless band is frictionally driven by the advancing web, thus eliminating any possibility of scuffing or marring the web surface or any printed matter thereon. Pulleys 72, 74 are fixed and pulley 76, located at the apex of the triangular array, is movably suspended from a rod 80 which slidably extends through a vertical bore 82 in the yoke member 70 and a slot 84 in support plate 60. A spring 86 is concentrically arranged on the rod 80 between the yoke member 70 and a stop nut 88 on rod 80 so as to apply an upward resilient force or bias to pulley 76 and thereby create a tensile force in the band 78 proportional to the spring constant of spring 86.

The pressure yoke assembly 59 is vertically adjustable from its raised position shown in FIG. 5 to its lowered, operative position shown in FIG. 4 by means of four shafts 90, the upper ends of which are secured to the four corners of yoke support plate 60. The lower ends of the shafts 90 are secured to a lower support plate 92 which is raised and lowered by an air motor 94 and jack 96 connected to a jack shaft 98. The shafts 90 are supported by and vertically guided in four upstanding guide tubes 100 which are rigidly affixed to the base 44.

The interrelationship between the height of the yoke 14, the compression of spring 86, the arcuate portion of the drum periphery engaged by the band 78, the tension in the band, and the pressure applied to the web P is complex, but can be summarized as follows. For a given band tension, lowering the yoke 14 tends to increase the arcuate portion of the drum periphery engaged by the band and the pressure applied to the web P. Tightening nut 88 to increase the compression of spring 86 tends to increase the tension in the band and the pressure applied to the web P. By appropriate adjustment of the vertical position of the yokes 14 and the tension in the bands 78, optimum pressure on the web P can be maintained for given operating conditions, such as web speed, abrasive material characteristics, abrasive wear and the like.

A hand crank 102 and shaft 103 (FIGS. 4 and 5) operates a second jack 104, to raise and lower a stop pin 106. Stop pin 106 is in alignment with and positioned directly below shaft 98 and functions as a limit stop to permit accurate repositioning of the pressure yoke assembly 59 after it has been raised, for example, to rethread the web through the apparatus.

Drum 12 and motor 50 are mounted upon a slide 112 which is supported by and transversely slidable back-and-forth along a pair of rods 110, 111 mounted in blocks 113, 115 on base 44. A stepping motor 108 is connected by an appropriate gearing mechanism 114 to a shaft 116 which is connected to a slide block 118 depending from the slide 112. The motor 108 operates between 0.5 and 1 cycles per minute to reciprocate slide 112 and thus drum 12 back-and-forth over an approximately $\frac{3}{8}$ inch amplitude, thus assuring that the sandpaper strips 54 wear evenly.

The drum 12 is driven by a drive motor 50 that is electrically and adjustably slaved to the drive means for the perforator station 16 by a conventional motor control means 51. By appropriate adjustment of the control means, the speed of the drum 12 can be set proportional to the speed of the perforator drive means. Preferably, the surface speed of drum 12 should be about seven times the speed of the web of paper P, although ranges from five to ten times the paper speed are acceptable. The preferred web speed is about 400 feet per minute.

Brush 28 is mounted adjacent the drum 12 on the upstream side thereof and prevents deposits from accumulating on the abrasive surfaces of the drum 12. Brushes 30, 32 are arranged downstream of the drum on opposite sides of the web P to clean dust and loose particles from the web P after it has been abrasively treated by the drum 12. Suction shoes 120, 122, 124 are mounted over the brushes 28, 30, 32, respectively, to suction off loose dust and particulate matter brushed from the drum and web. The brushes 28, 30, 32 are journalled in bearings (not shown) mounted at each end of the suction shoes 120, 122, 124 and are rotatably driven by a conventional drive mechanism, such as a pulley, belt and drive motor (not shown). Each suction shoe 120, 122, 124 is connected by appropriate conduits 126 to a vacuum manifold 128.

A vacuum hood (not shown) may be provided to cover the entire abrading apparatus to contain paper debris that is not collected by the suction shoes and to keep the apparatus clean.

In operation of the inventive device, the web of paper P is unwound from roll 20, passed through the infeed metering station 24 and into the perforator station 16. The perforator station forms a plurality of parallel rows 36 of holes 38 in the web of paper P. As previously described, the perforation process leaves undesirable remnants or "flaps" 40 of paper adhered to the periphery of each hole.

To remove the flaps, the paper P is fed to the abrading apparatus 10 by passing the paper under roller 56 such that the surface of the paper web from which the flaps 40 depend does not contact surface of the roller 56. The web is then drawn over drum 12 with the flaps interposed between the paper web P and the abrasive surface of drum 12. The pressure yokes 14 are lowered by jack 96 until the bands 78 of each yoke 14 contact the web P with the desired amount of pressure. Fine adjustment of the pressure may be accomplished by adjusting nut 88 on each yoke 14.

As the paper web P is drawn over the drum 12 under appropriate pressure, the abrasive strips 54 of the drum abrade the flaps 40 from the paper web P. Brush 28 continuously cleans drum 12 to prevent debris from collecting on the abrasive strips 54. Brushes 30, 32 continuously clean the paper web P after the flaps 40 have been abraded to remove any loose particles therefrom. During the abrading process, motor 108 causes the drum 12 to slowly reciprocate transversely to the path of the paper to assure that the abrasive material wears evenly.

After the paper P is cleaned by brushes 30, 32 it passes beneath roller 58, out to the porosity monitor 18 and thence to the rewind station 26.

Although only a preferred embodiment is specifically illustrated and described herein, it will be appreciated that many modifications and variations of the present invention are possible in light of the above teachings and within the purview of the appended claims without departing from the spirit and intended scope of the invention.

What I claim is:

1. Apparatus for removing perforation flaps from a perforated web, comprising:

drum means surfaced with abrasive material for abrading the flaps from the web;

means connected to said drum means for rotating said drum means in one direction at a predetermined peripheral speed of the drum means;

means arranged adjacent the drum means for passing said web into contact with an arcuate portion of the drum means periphery in said one direction at a speed less than the peripheral speed of the drum means, the flaps of said web being interposed between the web and the drum means;

means arranged in confronting relation with the arcuate portion of said drum means for applying pressure against the outwardly facing surface of the web, said pressure applying means comprising a yoke, three idler pulleys mounted on said yoke in a triangular array and an endless band arranged about said pulleys, means connected to one of said pulleys for resiliently biasing said one pulley in a direction to apply tension to the band.

2. Apparatus according to claim 1, including support means mounting said yoke adjacent said drum means such that said endless band is engagable with said web over the arcuate portion of said drum means and means for moving said support means toward and away from the drum means to vary the pressure applied to that portion of the web engaged by said band.

3. Apparatus according to claim 1, including means mounting said drum means for reciprocating movement along the rotational axis thereof and means connected to said mounting means for reciprocating said drum means along the rotational axis thereof.

4. Apparatus according to claim 1, including first guide roller means arranged upstream of the drum means for guiding the web into tangential contact with the drum means periphery and a second guide roller means arranged downstream of the drum means for guiding the web tangentially away from the drum means.

5. Apparatus according to claim 4, wherein said first and second guide roller means are arranged adjacent the drum means such that the web contacts an arcuate portion of said drum means periphery of from 60° to 120°.

6. Apparatus according to claim 5, wherein said arcuate portion is about 80° to 90°.

7. Apparatus according to claim 1, wherein the peripheral speed of said drum means is about 5–10 times the speed of the web.

8. Apparatus according to claim 7, wherein the peripheral speed of said drum means is about seven times the speed of the web.

9. Apparatus for removing perforation flaps from one side of a perforated web of indeterminate length traveling in a given direction comprising:

means along a path for moving said web along said path at a predetermined speed;

perforator means arranged along said path for perforating said web;

means connected to said perforator means for driving said perforator means thereby forming flaps on the web;

drum means surfaced with abrasive material and arranged along said path downstream of the perforator means for abrading the flaps from the web;

means connected to the drum means for rotating the drum means in a given peripheral direction and at a peripheral speed greater than the predetermined speed of the web;

means arranged adjacent the drum means for passing said web into contact with an arcuate portion of the drum means periphery and in the same direction as the peripheral direction of rotation of the drum means;

means arranged in confronting relation with the arcuate portion of said drum means for applying pressure to the outwardly facing surface of the web, said pressure applying means being driven in the same direction as the web by the frictional engagement between the web and the pressure applying means; said pressure applying means comprising a support member, a plurality of pulleys rotatably journalled on said support member, an endless band arranged about said pulleys, means for urging a portion of said endless band into frictional engagement with the web; and means for varying the arcuate portion of the drum means and the pressure applied to the web, said varying means comprising means connected to one of said pulleys for resiliently biasing said one pulley in a direction to apply tension to the endless band and means connected to said support member for moving said support member toward and away from the drum means.

10. Apparatus according to claim 9, including control means connected between said driving means and said rotating means for controlling the peripheral speed of the drum means proportional to the speed of the driving means.

* * * * *